US005649323A

United States Patent [19]

Kalb et al.

[11] Patent Number: 5,649,323

[45] Date of Patent: Jul. 15, 1997

[54] COMPOSITION AND PROCESS FOR THE ENCAPSULATION AND STABILIZATION OF RADIOACTIVE HAZARDOUS AND MIXED WASTES

[76] Inventors: Paul D. Kalb, 21 Barnes Road, Wading River, N.Y. 11792; Peter Colombo, 44 N. Pinelake Dr., Patchogue, N.Y. 11772

[21] Appl. No.: 375,387

[22] Filed: Jan. 17, 1995

[51] Int. Cl.[6] ..... G21F 9/00

[52] U.S. Cl. ..... 588/8; 588/255; 976/DIG. 383; 252/625

[58] Field of Search ..... 588/6, 8, 255; 264/0.5; 106/802, 803, 218; 976/DIG. 383; 252/625

[56] References Cited

U.S. PATENT DOCUMENTS

| | | | |
|---|---|---|---|
| 4,010,108 | 3/1977 | Gablin et al. | 588/6 |
| 4,058,479 | 11/1977 | White et al. | 588/16 |
| 4,234,632 | 11/1980 | Lubowitz | 428/2 |
| 4,242,220 | 12/1980 | Sato | 588/8 |
| 4,253,985 | 3/1981 | Filter et al. | 588/8 |
| 4,280,922 | 7/1981 | Puthawala et al. | 588/5 |
| 4,409,137 | 10/1983 | Mergan et al. | 588/3 |
| 4,560,501 | 12/1985 | Minami et al. | 422/131 |
| 4,629,509 | 12/1986 | O'Hara et al. | 106/118 |
| 4,702,862 | 10/1987 | Ledebrink | 588/8 |
| 4,756,681 | 7/1988 | Unger et al. | 425/112 |
| 4,762,646 | 8/1988 | Fougeron et al. | 588/3 |
| 4,772,430 | 9/1988 | Sauda et al. | 588/8 |
| 4,775,495 | 10/1988 | Izumida et al. | 588/14 |
| 4,834,917 | 5/1989 | Ramm et al. | 588/15 |
| 4,859,395 | 8/1989 | Unger et al. | 264/254 |
| 4,932,853 | 6/1990 | Unger et al. | 425/112 |
| 4,943,394 | 7/1990 | Lammertz et al. | 588/4 |
| 4,975,224 | 12/1990 | Pringle | 588/255 |
| 4,990,371 | 2/1991 | Dutta et al. | 427/213 |
| 5,037,479 | 8/1991 | Stanforth | 106/691 |
| 5,078,924 | 1/1992 | Spinello | 264/500 |
| 5,164,123 | 11/1992 | Goudy, Jr. | 588/6 |

OTHER PUBLICATIONS

Maeda, et al, Solidification of Radioactive Ash with Thermoplastic Resin, 1986, 71–Nuclear Technology vol. 108 No. 102, 102809m.

Logsdon, B.W. et al, A Preliminary Study of Heavy Metal Leach–ability from Polyethylene Encapsulated Nitrate Salt Waste at Rock Flats, 1993, 71–Nuclear Technology vol. 123, No.299585z.

Kalb, P.D., et al., "Polyethylene Solidification of Low–Level Wastes," *BNL Report No. 51867*, 1984.

Kalb, P.D. et al., "Encapsulation of Mixed Radioactive and Hazardous Waste Contaminated Incinerator Ash in Modified Sulfur Cement," *BNL Report No. 43691*, 1990.

Freudmann, A., "Brookhaven Encases Nuclear and Hazardous Wastes in Plastic," *New Technology Week*, 1991.

Kalb, P.D., et al., "Polyethylene Encapsulation of Nitrate Salt Wastes: Waste Form Stability, Process Scale–Up, and Economics," *BNL Report No. 52293*, 1991.

Kalb, P.D. et al., "Polyethylene Encapsulation of Single–Shell Tank Low–Level Wastes," *BNL Report No. 52365*, 1992.

Kalb, P.D. et al., "Long–Term Durability of Polyethylene for Encapsulation of Low–Level Radioactive, Hazardous and Mixed Wastes," Chapter 22, *American Chemical Society*, 1993.

Kalb, P.D., et al., "Polyethylene Encapsulation of Single Shell Tank Low–Level Wastes," *BNL Report No. 48607*, 1993.

Kalb, P.D., et al., "Polyethylene Encapsulation of Simulated Blowdown Waste for SEG Treatability Study," *BNL Report No. 49738*, Apr. 15, 1994.

Kalb, P.D., et al., "Thermoplastic Encapsulation Treatability Study for a Mixed Waste Incinerator Off–Gas Scrubbing Solution," *Third International Symposium on Stabilization/Solidification of Hazardous, Radioactive, and Mixed Wastes*, Nov. 1993.

*Primary Examiner*—Ngoclan Mai
*Attorney, Agent, or Firm*—M. C. Bogosian

[57] ABSTRACT

The present invention provides a composition and process for disposal of radioactive, hazardous and mixed wastes. The present invention preferably includes a process for multibarrier encapsulation of radioactive, hazardous and mixed wastes by combining substantially simultaneously dry waste powder, a non-biodegradable thermoplastic polymer and an anhydrous additive in an extruder to form a homogenous molten matrix. The molten matrix may be directed in a "clean" polyethylene liner, allowed to cool, thus forming a monolithic waste form which provides a multibarrier to the dispersion of wastes into the environment.

10 Claims, 2 Drawing Sheets

COMPOSITION AND PROCESS FOR THE ENCAPSULATION AND STABILIZATION OF RADIOACTIVE HAZARDOUS AND MIXED WASTES

This invention was made with Government support under contract number DE-ACO2-76CHOOO16, between the U.S. Department of Energy and Associated University, Inc. The Government has certain rights in the invention.

BACKGROUND OF THE INVENTION

This invention relates to a composition and process for disposing of radioactive, hazardous and mixed wastes, and, in particular, to encapsulation and stabilization of low-level radioactive, hazardous and mixed wastes.

Industrial wastes which are not economical to recycle must be disposed of in the environment. Some of this waste material can be rendered harmless and then disposed of in a convenient manner. Other wastes, however, such as heavy metals, for example, mercury, lead, antimony, arsenic, and radioactive substances, cannot be rendered harmless. Consequently, the disposal of these materials into the environment must be made in a manner in which they are stabilized against dispersion into the environment.

Large volumes of low-level radioactive wastes are routinely generated through the operation of defense-related and commercial nuclear facilities. As a result of its defense and research activities, the Department of Energy (DOE) generates not only low level radioactive waste, but also hazardous and mixed waste. Hazardous and mixed wastes at DOE facilities include a broad range of waste types, such as evaporator concentrates, salts, blowdown slurries, sludges, filter materials, ion exchange resins, and incinerator ash, that encompass diverse physical and chemical properties. Many of these wastes have been identified as problem wastes because they are difficult to encapsulate using conventional technologies and/or produce waste forms of poor quality that do not successfully retain hazardous constituents in the disposal environment.

Due to reductions in volume resulting from incineration of contaminated combustible materials, remaining ash residues may contain sufficient quantities of hazardous elements, including heavy metals, that they meet the Environment Protection Agency (EPA) definitions for hazardous waste as well as DOE definitions for low-level radioactive waste. According to EPA's guidelines for delisting of hazardous and mixed wastes, before disposal at approved low-level waste disposal sites, such wastes must first be treated to immobilize the hazardous constituents.

Attempts have been made in the past to render radioactive, hazardous and mixed wastes harmless by immobilizing the wastes against dispersion by ecological forces.

In one method, the mixed wastes are sealed into metal or plastic containers which are then stored underground or in the ocean. In another method, the wastes are incorporated into a matrix of materials, such as inorganic cements and polymers while in their fluid or molten state followed by solidification. The high viscosity of molten plastics generally has limited the quantity of waste which can be loaded into the plastic matrix.

Frequently, incorporation of wastes in a plastic mixture is limited by the inability of the matrix to isolate the waste from the environment. Highly loaded matrices having over 30 percent loadings have been unsatisfactory because of leaching. Thus, one disadvantage of known processes used to encapsulate waste is the tendency of waste to become mobilized. Other disadvantages of conventional hydraulic cement and other thermosetting polymer processes include low efficiency of waste encapsulation, a requirement to cure the matrix by adding chemicals and/or increasing the temperature, steps which result in increased operating costs.

Accordingly, there is still a need in the art of waste disposal to provide a composition and method for encapsulating and stabilizing radioactive, hazardous and mixed wastes.

It is, therefore, an object of the present invention to provide a composition and process for encapsulating and stabilizing radioactive, hazardous and mixed wastes in a multi-barrier process. Another object of this invention is to provide durable waste forms which can withstand mobilization by ecological forces. Yet, another object of the present invention is to develop an encapsulating process which has no curing requirements for solidification, thus providing significant cost savings.

SUMMARY OF THE INVENTION

The present invention, which addresses the needs of the prior art, provides a composition and a process for the disposal and immobilization of radioactive, hazardous and mixed wastes. More specifically, it has now been found that by heating and mixing in an extruder, substantially simultaneously, (i) dry waste powder including radioactive, hazardous and mixed wastes;

(ii) a non-biodegradable thermoplastic polymer; and (iii) an anhydrous additive capable of forming a precipitate with the radioactive and/or toxic materials found in the dry waste powder;

a molten homogenous waste matrix is obtained which is conveyed into a substantially pure or "clean" polyethylene container, wherein the molten matrix cools slowly to form a solid waste form which has an exterior layer of substantially pure or "clean" polyethylene.

The anhydrous additives used to form insoluble precipitates with the radioactive and toxic materials include calcium hydroxide, sodium hydroxide, sodium sulfide, calcium oxide, magnesium oxide or a mixture thereof. Loss-in-weight feeders are used to provide the components of the molten waste mixture to the extruder in precise predetermined ratios. Pretreating steps include drying and comminuting all waste to a dry waste powder having a particle size not greater than 3,000 microns. Waste particles which are less than 50 microns are pre-mixed with polyethylene binder by a high-speed kinetic batch mixer to form a homogenous waste mixture prior to charging into the extruder.

As a result of the present invention a composition and process for disposal of radioactive, hazardous and mixed waste are provided, wherein radioactive and toxic wastes are stabilized by forming insoluble precipitates with chemical additives, all enclosed in a monolithic waste form having at least a second barrier to leaching of waste components into the environment.

In contrast to hydraulic cement and thermosetting polymer processes, the present invention does not require chemical reactions for solidification, so that waste-binder interactions are minimized. The present invention allows a broader range of waste types to be encapsulated and results in better waste loading efficiencies, i.e., more waste per container. Preferred formulations prepared in accordance with the present invention can contain as much as 60% by weight, while still maintaining leachability of toxic metals below allowable EPA criteria. In contrast, maximum loadings using conventional Portland cement are limited to about 16% by weight ash.

Other improvements which the present invention provides over the prior art will be identified as a result of the following description which sets forth the preferred embodiments of the present invention. The description is not in any way intended to limit the scope of the present invention, but rather only to provide a working example of the present preferred embodiments. The scope of the present invention will be pointed out in the appended claims.

DETAILED DESCRIPTION OF THE INVENTION

Figure 1:
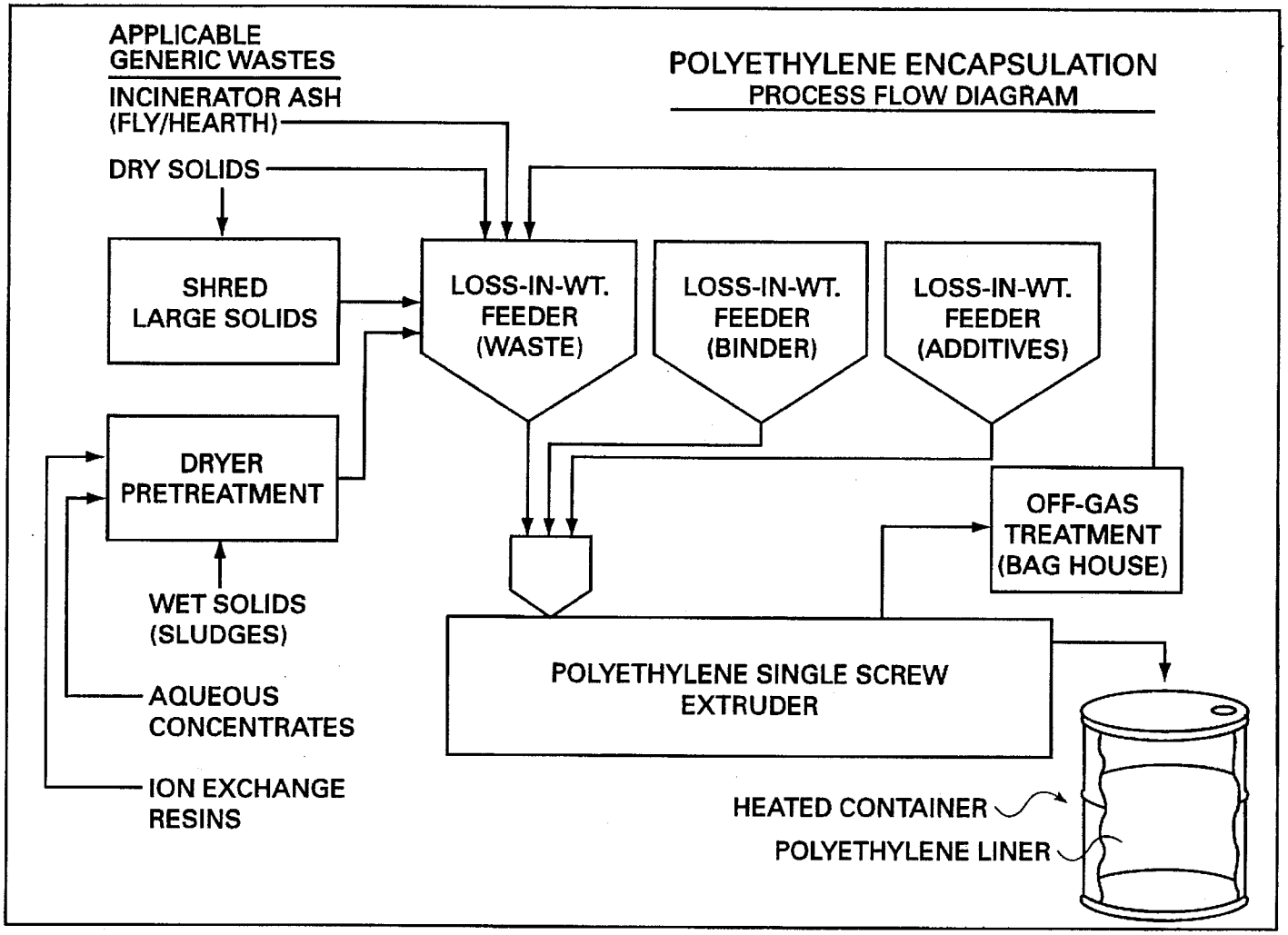
FIG. 1 is a process flow diagram of a process for polyethylene encapsulation for treatment of low-level radioactive, hazardous and mixed wastes used in the present invention.

In accordance with the present invention, a process for encapsulating and stabilizing radioactive, hazardous and mixed wastes in a non-biodegradable thermoplastic polymer composition is provided.

The composition of the present invention includes the following components:

(i) a dry waste powder of radioactive, hazardous and mixed wastes reduced to a size not greater than 3,000 microns;

(ii) a non-biodegradable thermoplastic polymer; and (iii) an anhydrous additive which is capable of forming insoluble precipitates with the radioactive and/or toxic materials found in the dry waste powder.

As used in the present invention radioactive waste refers to low level radioactive material as defined by Nuclear Regulatory Commission Regulations ("NRC") set forth in 10 CFR 61. Low level radioactive wastes do not include spent nuclear fuel, transuranic waste or byproduct materials which are defined as high-level radioactive wastes in §11 e(2) of the Atomic Energy Act of 1954 at 43 U.S.C. 2014 (e). Low-level radioactive wastes ("LLW") include radioactive material found in evaporator concentrate, ion exchange resins, incinerator bottom ash, filtration sludges, and contaminated filters and membranes. Cs-137, Co-57 and Sb-125 are common radioactive constituents.

Hazardous waste refers to solid waste that may pose a substantial present or potential hazard to human health and the environment when improperly treated, stored, transported, disposed or otherwise managed as defined by §1004 (5) of the Resource Conservation and Recovery Act as set forth at 40 CFR 261, EPA 55 Fed. Reg. 11862 (March 1990). Hazardous waste does not include low level radioactive waste. Hazardous materials include arsenic, lead, cadmium, mercury and other metals identified by EPA as toxic metals.

Mixed waste as used herein refers to waste which includes low level radioactive waste and hazardous waste. A more complete definition of mixed waste is set forth in a Memorandum of Understanding between the NRC and EPA and as published at 51 Fed. Reg. 24505 (Jul. 3, 1986). Mixed wastes include aqueous process steps, sludges, debris, and ash waste.

Waste types which may be encapsulated according to the encapsulation process of the present invention include incinerator blowdown solution, sludges, molten salt oxidation residues, ion exchange resins and municipal solid waste incinerator ash. Incinerator blowdown solution may include chloride salts, incinerator flyash, toxic metals and radionuclides. Sludges treatable according to the process of the present invention include calcium and sodium carbonate, nitrates, EDTA chelating agent and toxic metals. Molten salt oxidation process residues include primarily calcium carbonate salts and miscellaneous fission products and toxic metals. Ion exchange resins are used to remove hazardous contaminants from process streams and can contain radionuclides and toxic metals.

Prior to combining with the non-biodegradable thermoplastic polymer, the radioactive, hazardous and mixed wastes have been subjected to pre-treatment steps in order to render all wastes substantially anhydrous. The wastes are pretreated to a dry powder having a particle size reduced to not greater than approximately 3,000 microns.

Any non-biodegradable thermoplastic polymer may be used as a waste encapsulating or binding agent, and those which are softened or melted at temperatures from about 120° C. to about 260° C. can generally be most conveniently used. Thus, thermoplastic polymers such as polyethylene, polyvinyl chloride, polypropylene and the like are useful for the composition and process of the present invention.

Polyethylene is an inert thermoplastic polymer with a melt temperature of 120° C. When heated above its melting point, polyethylene can combine with waste to form a homogenous mixture, which upon cooling, yields a monolithic solid waste form. In contrast to conventional binding agents, such as hydraulic cement the use of polyethylene as a binder has several distinct advantages. Solidification is assured on cooling because no curing chemical reactions are required. A wide range of waste types are compatible with polyethylene because constituents present in the waste will neither inhibit nor accelerate solidification. Polyethylene encapsulation results in higher loading efficiencies and better waste form performance when compared with hydraulic cements. For example, up to 70 weight % nitrate salt waste can be encapsulated in polyethylene compared to a maximum of 13–20 weight % using Portland cement. Improved waste form properties such as durability and leachability are attained. Processing is simplified as variations in waste composition do not require adjustment of the solidification chemistry. As a result, polyethylene encapsulation processes provide overall cost savings.

Two detailed reports on the properties of polyethylene which result in the formation of durable polyethylene forms have been prepared by P. D. Kalb et al. The reports are entitled "Polyethylene encapsulation of nitrate salt wastes: waste form stability, process scale-up and economics," BNL 52293, DOE/OSTI-4500, R75, 1991 and "Long-term durability of polyethylene for encapsulation of low-level radioactive, hazardous and mixed wastes," Chapter 22, *American Chemical Society*, 1993, both of which are incorporated herein by reference as if set forth in full.

Low density polyethylene is the preferred binder for the composition and process of the present invention. Low density polyethylene which has a high melt index and as a result low melt viscosity is most preferred.

Low density polyethylene (LDPE) is produced by a process which utilizes high reaction pressures (15,000 to 45,000 psi) resulting in the formation of large numbers of polymer branches. These branches occur at a frequency of 10–20 per 1000 carbon atoms, creating a relatively open structure. Typically, low density polyethylenes have densities ranging between 0.910 and 0.925 g/cm$^3$. High density polyethylene (HDPE) is manufactured by a low pressure (<1500 psi) process in the presence of special catalysts which allow the formation of long linear chains of polymerized ethylene. There are very few side chain branches in a HDPE molecule resulting in a close packed or dense structure. HDPE densities range between 0.941 and 0.959 g/cm$^3$. Medium density polyethylenes (0.926–0.940 g/cm$^3$) can be formulated by either high or low pressure methods, or by combining LDPE and HDPE materials.

The properties of low, medium, and high density polyethylenes have been summarized by Schuman, R. C., in "Polyethylene," *Modern Plastics Encyclopedia,* 52, No. 10A, J. Agranoff, ed., McGraw Hill Publications Co., New York, October 1975, the contents of which are incorporated by reference as if set forth in full.

The properties of high density polyethylene, e.g., mechanical strength and resistance to harsh chemical environments might provide a slight advantage in the solidification of low-level radioactive waste. Processing of high density polyethylene is more difficult, however, as it requires greater temperatures and pressures. The properties of LDPE are nonetheless favorable, and thus LDPE is preferred as encapsulating or binding agent for the present invention. Injection molding grade LDPE having a high melt index from about 50 g/10 minutes to about 55 g/10 minutes is most preferred because it has the optimal melt viscosity for mixing with waste constituents found in the process of the present invention.

Polyethylene has been used as a binder for encapsulation of a wide range of waste types. The resulting waste form provides a strong, durable waste encapsulating matrix which is resistant to ionizing and gamma radiation, microbial degradation, chemical attack by organic and inorganic solvents, environmental stress cracking and photodegradation. Polyethylene waste forms have also been rated by the National Fire Protection Association as "slight" based on its relatively high flash and self-ignition points. For example, results of the foregoing specific potential failure mechanisms conducted on waste form encapsulating nitrate salts generated at several DOE facilities are set forth in Chapter 22, entitled "Long-Term Durability of Polyethylene for Encapsulation of Low-Level Radioactive, Hazardous and Mixed Wastes," supra. The results of these tests, indicate that polyethylene waste forms are extremely resistant to each of these potential failure modes under anticipated storage and disposal conditions.

The composition of the present invention also includes low concentrations of anhydrous additives capable of forming precipitates with toxic and/or radioactive components. Useful additives include calcium hydroxide, sodium hydroxide, calcium oxide and magnesium oxide. The preferred composition of the present invention includes a low concentration of sodium sulfide in an amount from about 0% wt. to about 10% wt. Sodium sulfide reduces the solubility of many toxic metals by forming precipitates with, for example, lead, cadmium and chromium, thereby significantly reducing their leachability from the waste form of the present invention.

The loadings of dry waste can be from about 10 wt. % to about 70 wt. % of the composition of the present invention and still maintain 2000 psi compressive strength. The low-density polyethylene binder can be present in a concentration from about 30 wt. % to about 90 wt. % of the composition. The additive may be found in a concentration from about 0% wt. to about 10% wt.

A preferred composition of components is approximately 50% by weight dry waste, approximately 40% by weight low-density polyethylene and approximately 10% by weight anhydrous sodium sulfide.

Monolithic waste forms containing as much as 61.5 wt. % of surrogate waste including radioactive, hazardous and mixed waste as generated at Consolidated Incinerator Facility ("CIF") of the Scientific Ecology Group Treatability study for Westinghouse Savannah River Company's blowdown waste have been formulated in accordance with the present invention. By contrast, only 10 wt.% maximum loading for this type of waste have been achieved for hydraulic cement and 55 wt. % for modified sulfur cement. Compressive strengths of the waste forms made in accordance with the present invention exceeded 2100 psi at 61.5 wt. %.

Leaching testing of the waste forms obtained in accordance with the present invention was conducted according to the EPA Toxicity Characteristics Leaching Procedure ("TCLP") as set forth in U.S. Environmental Protection Agency, 40 CFR 261, "Identification and Listing of Hazardous Waste," Fed. Reg. 51, 21865, Jun. 13, 1986. TCLP leachability testing at a waste loading of 61.5 wt. % of CIF surrogate waste yielded metal concentrations above allowable limits for six of twelve toxic metal contaminants. Encapsulation in polyethylene binder of CIF waste surrogate mixed with a small quantity of anhydrous sodium sulfide, preferably in a proportion of 5:1, waste:anhydrous additive, reduced TCLP leachate concentrations further. For example, at waste loadings of 20 wt. %, 30 wt. % and 40 wt. % CIF surrogate waste, the TCLP concentrations were significantly below EPA maximum allowable concentrations for all three waste loadings.

The composition of the present invention can be provided by an integrated, multi-barrier process for disposal of low-level radioactive, hazardous and mixed wastes. More specifically, pre-treated, dry waste particles not greater than about 3,000 microns are combined with anhydrous chemical additives and an inert, non-biodegradable thermoplastic binder and simultaneously subjected to heating and mixing conditions to form a homogenous molten matrix. The molten matrix is then conveyed into a substantially pure or "clean" polyethylene container, which is then heated to form a bond with the waste-plastic mixture, and is allowed to cool. The process of waste encapsulation provided by the present invention is set forth in FIG. 1 hereto.

In preparation for encapsulation, aqueous liquid wastes are pre-treated to a dry powder within specified moisture content range from about 0.0% by weight to about 10% by weight, using a stirred, vacuum dryer system or other suitable drying technique. Sludge wastes are brought to dryness by means of either a vacuum dryer system or a continuous belt oven dryer. Dry solids, namely those resulting from the drying processes or produced directly are screened for acceptable particle size range and, if necessary, are size-reduced by means of a crusher, hammer mill other comminution device.

Microprocessor controlled, loss-in-weight feeders, such as Accu-Rate Model 610 as manufactured by Accu Rate Corp., White Water, Wis. can be used to provide the components of the molten waste mixture to the extrusion equipment. Dry waste powder, low density polyethylene pellets and precipitating anhydrous additives are separately fed to the extrusion equipment through three (3) loss-in-weight feeders. Each feeder can be microprocessor controlled in order to monitor precisely the instantaneous weight loss as each component is delivered. Each individual feeder is regulated by a master controller which monitors and adjusts the delivery to maintain a predetermined ratio among the three components of the mixture. For example, a preferred waste to polyethylene to precipitating additives ratio is 50 wt. % waste to 40 wt. % polyethylene to 10 wt. % additives.

The loss-in-weight feeders deliver the waste, polyethylene binder and precipitating additives into an extruder to form a homogeneous and molten mixture. Any extruder such as a single or multiple screw configuration can be used, provided that it is properly sized. For the present invention, the extruder is preferably a single-screw extruder available from Killion Extruders, Inc. in Cedar Grove, N.J. or Davis-Standard Extruders, Pawcatuck, Conn. The extruder has three or more separately controlled heating zones and one or more die zones. Instrumentation and monitoring of process parameters are essential in the control of the process. Zone temperatures, melt temperatures, melt pressure, current draw and screw speed are carefully monitored during processing. By using an extrusion process, the dry waste powder, binder and anhydrous additives are simultaneously heated, mixed and conveyed and a homogenous, molten mixture of all components is obtained which is then extruded into a container made of virgin or recycled polyethylene.

To reduce leachability even further, the polyethylene from which the container is made is "clean" in that it is not mixed with any radioactive wastes or other toxic chemicals. In that way, the leachability of contaminants trapped at or near the surface of the waste form is minimized. The container may also be made of recycled polyethylene in lieu of virgin polyethylene, provided that the recycled polyethylene is free of radioactive and toxic materials.

The "clean" polyethylene container is kept in a heatable mold which keeps the walls of the container hot so that a bond is formed between the extruded molten mixture and the polyethylene container. The mold may be heated by band heaters or the like. After the "clean" polyethylene liner is filled with the extruded, molten waste matrix, a second stream of co-extruded, molten "clean" polyethylene is extruded on top of the waste/binder/additive mixture. Upon coating, the second layer of "clean" polyethylene forms the top layer of the outer "clean" polyethylene barrier. The entire package is allowed to cool slowly so that a multi-barrier monolithic waste form is obtained. The exterior skin of "clean," virgin or recycled polyethylene becomes thermally bonded with the encapsulated waste to form a seamless and permanent surface which provides an additional barrier to the penetration of water into the waste form and migration of contaminants from the waste form. The virgin or "clean" polyethylene liner or container has a wall thickness from about 3 mil to about 5 mil.

In another embodiment of the present invention the multi-barrier encapsulation is achieved by first extruding virgin or "clean" polyethylene into a drum, followed by extruding the molten mixture of waste, additive and binder. Because of different densities, the lighter virgin or "clean" polyethylene envelops the denser waste/additive/binder mixture. In this way, at least a second thermoplastic encapsulation layer is provided which further prevents the wastes from dispersing into the environment. The drum is preferably made of steel. For a 55 gallon drum when the thickness of "clean" polyethylene layer is 1 cm the ratio of virgin or "clean" polyethylene to waste/additive/binder mixture is 0.09 on volume basis. When the thickness of the "clean" polyethylene layer is 2.5 cm, the ratio of "clean" polyethylene found in the layer to the waste/additive/binder mixture is 0.26 on volume basis.

In yet another embodiment, a multibarrier encapsulation is achieved by coextruding a layer of "clean" polyethylene around a core of waste/additive/binder mixture. The encapsulation is accomplished by using two extruders simultaneously, one for preparing the waste/additive/binder molten mixture and the other to form the "clean" polyethylene outer layer. The two extrudates are forced through a common die. The die has a large core section, preferably circular through which the waste/additive/binder molten mixture is forced and a thinner peripheral section through which the "clean" polyethylene is flown thereby obtaining a rod like waste form. The rod can have a core of waste mixture which has a diameter from about 2 inches to about 10 inches and a "clean" polyethylene outer layer which has a thickness from about ⅜ inch to about 1 inch. The coextruded rod or log is extruded onto a moving belt where it is cooled either by air or water and is cut into convenient lengths for stacking within steel drums.

Encapsulation of contaminants within a waste form is the first of several barriers used to isolate radioactive, hazardous and mixed wastes from the accessible environment. The durability of waste forms over long periods of time can therefore play an important role in ensuring continued isolation of contaminants. The approach used in testing the composition of the present invention was to provide reasonable assurance that waste forms will be structurally stable over time, involving application of short-term conditioning and property tests that reflect the anticipated conditions of disposal. This is the same approach used by the U.S. NRC for the licensing of commercial LLW forms from nuclear power plants, as published in the "Branch Technical Position on Waste Form," Rev. 1, Washington, D.C. (May 1991) in support of regulations contained in 10 CFR 61, (U.S. Code of Federal Regulations, Title 10, Energy, "Part 61—Licensing Requirements for Land Disposal of Radioactive Waste"), U.S. Government Printing Office (1990).

The focus of the examples set forth below was to test the waste forms made by encapsulating radioactive, hazardous and mixed wastes in accordance with the present invention. Waste form performance testing included flammability, compressive strength, and leaching of toxic metal and radioactive constituents in accordance with NRC test guidelines for licensing of radioactive waste forms. The testing for leaching of hazardous constituents contained in the flyash (i.e., toxic metals) was performed according to the Environmental Protection Agency (EPA) protocol contained in 40 CFR 261, "U.S. Environmental Protection Agency, Identification and Listing of Hazardous Waste" Fed Reg , 45: 3319 (May 1980) These tests include the Extraction Procedure Toxicity Test (EP TOX), 40 CFR 261, Appendix II, "EP Toxity Test Procedures" 45 FR 3319 (May 1980), as amended by 48 FR 14293 (Apr. 1, 1983) and 50 FR 663 (Jan. 4, 1985); and the Toxicity Characteristic Leaching Procedure (TCLP) as defined in 40 CFR 261 Appendix II—"Toxicity Characteristic Leaching Procedure" (TCLP), 55 FR11863 (Mar. 29, 1990). The tests were conducted on selected formulations in order to assess mobility of contained EPA characteristic contaminants.

EXAMPLES

The following examples serve to provide further appreciation of the invention but are not meant in any way to restrict the effective scope of the invention.

Example 1

This example shows the use of LDPE to encapsulate surrogate waste including hazardous and mixed waste in a process in which the waste is pretreated with anti-leaching additives in an aqueous solution prior to drying the waste and coextruding with molten LDPE.

preparation of Surrogate Waste

Aqueous surrogate waste, representing blowdown waste from the Westinghouse Savannah River Co. Consolidated Incinerator Facility ("CIF") was used to prepare a waste specimen. The surrogate waste contained 35.3% solids and had a specific gravity of 1.265. The surrogate waste further contained metal tracers as shown in Table 1 below.

TABLE 1

Metal Concentrations For CIF Surrogate

| Compound | Symbol | Concentration, ppm |
|---|---|---|
| Silver | Ag | 500 |
| Arsenic | As | 250 |
| Barium | Ba | 500 |
| Cadium | Cd | 125 |
| Chromium | Cr | 500 |
| Mercury | Hg | 250 |
| Nickel | Ni | 500 |
| Lead | Pb | 2250 |
| Antimony | Sb | 500 |
| Selenium | Se | 500 |
| Thallium | Ti | 500 |
| Zinc | Zn | 500 |

Pretreatment of the Waste with an Anti-Leaching Agent 108.5 g of a soluble pre-treatment additive was added to approximately 6 liters of the CIF surrogate prior to drying the waste. The pre-treatment additive, namely sodium sulfide was added to reduce the leachability of the metal contaminants by reducing their solubility.

Drying of the Waste/Additive Solution

The surrogate waste/additive solution was pre-treated to provide a dry powder having a mean particle size of less than 1400 microns by using a bench-scale stirred vacuum dryer. The dryer had a 2-gallon stainless steel mixing vessel which was heated by a microprocessor controlled oil bath circulation heater. The oil bath was set to 80° C. The vessel temperature was monitored by way of a thermocouple at the vessel mid-section. Liquid temperature was maintained between 68° C. and 78° C. during boiling. Vacuum was maintained at 28–30 in. Hg. At these temperatures and vacuum, vigorous boiling was maintained. The vapor was removed by a water cooled condenser.

After drying for approximately 5.5 hours the surrogate waste/additive mixture had a moisture content of 0.74% moisture. Thereafter, the vacuum was maintained, the heat turned off and the stirrer set to keep the mixture dry. After 2.5 hours, 1598.7 g of dry surrogate waste containing anti-leaching additive was recovered and sieved through a 1.4 mm screen prior to extrusion processing to eliminate any large particles. The procedure yielded 912.1 g of dry waste having particles of less than 1.4 mm in size which was transferred to the metering hopper for extrusion.

A continuous belt oven dryer can be used to dry sludge wastes, when such wastes are present. Dry solids resulting from the drying process or produced directly can be screened for acceptable particle size range. If necessary, the dry wastes can be further size-reduced by means of a crusher, hammer mill or other comminution device.

Extrusion Processing

The pre-treated dry CIF surrogate/additive particles and LDPE pellets were fed separately through two loss-in-weight feeders into a 1.25 in. diameter bench-scale extruder with a maximum output of 16 kg/hr. LDPE was of injection-molding grade, had a density of 0.924 g/cc and was supplied by Chevron Chemicals, Houston, Tex. The feeders were controlled by microprocessors which monitored the instantaneous weight loss as material was delivered. The actual mass feed rate was compared with the pre-set rate and adjustments in delivery speed were made automatically to keep the feed rate within about 1% of the set rate. The two individual controllers were regulated, in turn, by a master controller which monitored and adjusted the delivery of each feeder so that the waste/additive to binder ratio was maintained. The feeders were set to maintain a ratio of 61.5 wt. % of additive pretreated surrogate waste to 38.5 wt. % polyethylene. The master controller maintained an overall delivery rate of 25 g/min, namely 15.4 g/min pretreated surrogate and 9.6 g/min polyethylene.

The extruder used in this example had three separately controlled heating zones and a die zone. Zone temperatures, melt temperature, melt pressure, current draw, and screw speed were monitored during processing. The data for the extrusion of CIF surrogate is given in Table 2 below.

TABLE 2

Extruder Parameters For Processing CIF Surrogate

| Zone 1 °F. | Zone 2 °F. | Zone 3 °F. | Die Zone °F. | Melt Temp °F. | Melt Press psi | Current Draw amps | Screw Speed rpm |
|---|---|---|---|---|---|---|---|
| 280 | 280 | 320 | 331 | 329 | 1400–2500 | 2–3 | 8–20 |

The molten mixture of CIF surrogate and polyethylene was extruded into Teflon pellet molds. The pellet size was approximately 0.25" diameter×0.25" height. On cooling, the pellets were removed from the molds and weighed. A Toxicity Characteristic Leaching Procedure ("TCLP") analysis was conducted on a set of pellets (101.2 g). The results are presented in Table 3 below.

TABLE 3

TCLP Data for 61.5 wt. % CIF Surrogate Encapsulated in Polyethylene

| Metal | TCLP Concentration, ppm | EPA Allowable Concentration[1], ppm |
|---|---|---|
| Silver | <0.0002 | 5.0 |
| Arsenic | 0.234 | 5.0 |
| Barium | 0.573 | 100.0 |
| Cadmium | 0.694 | 1.0 |
| Chromium | <0.004 | 5.0 |
| Mercury | 0.0008 | 0.2 |
| Nickel[2] | 2.76 | NA[2] |
| Lead | 7.32 | 5.0 |
| Antimony[2] | 1.19 | NA |

TABLE 3-continued

| TCLP Data for 61.5 wt. % CIF Surrogate Encapsulated in Polyethylene | | |
|---|---|---|
| Metal | TCLP Concentration, ppm | EPA Allowable Concentration[1], ppm |
| Selenium | 0.121 | 1.0 |
| Thallium[2] | 1.12 | NA |
| Zinc[2] | 6.11 | NA |

[1]Characteristic limits in accordance with 40 CFR Parts 261, 271 and 302
[2]NA — not applicable; no characteristic limit is specified by EPA because this metal is not considered a toxic material Table 3 indicates that at a high waste loading of 61.5 wt. % when the aqueous waste was pretreated with an aqueous solution of anti-leaching additive prior to the drying step, the TCLP leachability of the resulting waste form was above EPA allowable characteristic limit only for lead. Further investigation has shown as in Examples 2 and 3 below that, in a preferred embodiment, when the waste loading is reduced and the anti-leaching agent is added to the dry waste as an anhydrous additive, the TCLP leachability of the resulting waste form is significantly enhanced and values below EPA allowable characteristic limits are obtained for all of the toxic metals monitored. The TCLP leachability values shown in Table 3 demonstrate the excellent encapsulation achieved in the broadest aspect of the invention. In the preferred embodiment(s), the initial LDPE encapsulation reported in Table 3 is further subjected to at least a second encapsulation in a container made of virgin or "clean" polyethylene. The second encapsulation in a virgin or "clean" polyethylene container provides an additional barrier to leaching of radioactive, hazardous and mixed wastes. An example of this preferred embodiment of the present invention is set forth in Example 2 below.

Example 2

In this example, waste forms were provided according to a preferred embodiment of the present invention. In this embodiment, the waste loadings were decreased from 61.5 wt. % to 40 wt. %, 30 wt. % and 20 wt. %. In addition, the anti-leaching agent was added as an anhydrous additive after the surrogate waste was dried. The waste forms showed significantly improved TCLP leachability results.

Preparation of a Mixed Surrogate Waste Sample

An aqueous waste surrogate was prepared from two batches. One batch had a specific gravity of 1,268 and contained 32.7% solids. The other batch had a specific gravity of 1.265 and contained 35.3% solids. Each batch was pretreated according to the procedure of Example 1, except that no anti-leaching additives were added prior to drying of the waste. 0.94 kg and 1.43 kg of dried surrogate were recovered from each batch described above. A particle size distribution was conducted and particles between 20 μm to 1000 μm were utilized for encapsulation. A quantity of powdered, anhydrous anti-leaching additive was added to the dry waste surrogate of size less than 1000 μm in a ratio of 5:1, waste:additive. The dry waste and the anhydrous additive were mixed by means of an end-over-end tumbler for 1.5 hours.

The pre-treated mixture of dry waste and anhydrous additive were encapsulated in low-density polyethylene according to the procedure in Example 1. The settings for the loss-in-weight feeders used in this example are set forth in Table 4, below.

TABLE 4

| Loss-In-Weight Feeder Settings | | |
|---|---|---|
| Waste Loading, wt. % | Waste Additive Feeder, g/min | Polyethylene Feeder, g/min |
| 20 | 24 | 76 |
| 30 | 36 | 64 |
| 40 | 48 | 52 |

The extruder parameters used in this Example are set forth in Table 5, below.

TABLE 5

| Extruder Parameters | | | | | | | |
|---|---|---|---|---|---|---|---|
| Zone 1, °F. | Zone 2, °F. | Zone 3, °F. | Die Zone °F. | Melt Temp. °F. | Melt Press °F. | Current Draw, amps | Screw Speed, rpm |
| 300 | 300 | 300 | 315 | 305 | 40–1000 | 2–3 | 10–50 |

The molten mixture of CIF surrogate and polyethylene was extruded into Teflon® pellet molds. A TCLP analysis was conducted and the results are set forth in Table 6, below.

TABLE 6

| TCLP Data for 20, 30, and 40 wt. % CIF Surrogate Encapsulated in Polyethylene TCLP Concentrations, ppm[a,b] | | | | |
|---|---|---|---|---|
| Metal | 20 wt % | 30 wt % | 40 wt % | EPA Allowable[c] Concentration, ppm |
| Silver | <0.05 | <0.05 | <0.05 | 5.0 |
| Arsenic | 0.445 | 0.48 | 0.67 | 5.0 |
| Barium | 0.488 | 0.463 | 0.718 | 100.0 |
| Cadmium | <0.05 | <0.05 | <0.05 | 1.0 |
| Chromium | <0.05 | <0.05 | 0.065 | 5.0 |
| Mercury | <0.04 | <0.04 | <0.04 | 0.2 |
| Nickel[d] | 0.15 | 0.163 | 0.098 | NA[d] |
| Lead | <0.05 | <0.05 | <0.05 | 5.0 |
| Antimony[d] | 0.11 | 0.21 | 0.1 | NA |
| Selenium | <0.01 | 0.014 | 0.015 | 1.0 |
| Thallium[d] | <0.05 | 0.06 | <0.05 | NA |
| Zinc[d] | 0.403 | 0.473 | 0.285 | NA |

[a]Average for (2) replicates
[b]Data expressed as "<" represent analytical detection limit
[c]Characteristic limit in accordance with 40 CFR Parts 261, 271 and 302
[d]NA — not applicable; no limits specified by EPA because this metal is not considered a toxic material The results of Table 6 indicate that the TCLP leachability is significantly improved by two different changes in the process of the present invention. These changes represent a preferred embodiment of the present invention. The changes are as follows:

i) the waste loading was reduced from 61.5% to 20%, 30% and 40%, respectively; and ii) an anti-leaching agent was added as an anhydrous additive to dry waste prior to LDPE encapsulation.

As a result, all hazardous metal concentrations were reduced below listed EPA allowable characteristic concentrations.

The results shown in Table 6 demonstrate the efficacy of the broadest aspect of the present invention. It is noted, however, that these results do not necessarily represent maximum achievable waste loadings. The maximum waste loading can vary based on the type of waste and the concentration of contained contaminants. In a preferred embodiment of the present invention, the homogenous, molten dry waste/anhydrous additive/binder mixture is further extruded in a container made of virgin or "clean" recycled polyethylene which provides another barrier against leaching into the environment.

Additional Encapsulation in Substantially Pure or Recycled "Clean" Polyethylene In another embodiment of the present invention, the homogenous molten mixture of dry surrogate waste, anhydrous additive and polyethylene is extruded into a container made of virgin or recycled "clean" polyethylene. The polyethylene container is kept in a heatable mold so that a bond can be formed between the extruded molten waste mixture and the polyethylene container. After the "clean" polyethylene container is filled with molten extrudate, a second layer of "clean" polyethylene is extruded on top to envelop the entire waste form with another layer of virgin or "clean" polyethylene. The additional "clean" polyethylene layer provides another barrier to dispersion of undesirable toxic or radioactive wastes into the environment.

Example 3

In this example, waste forms having different waste loadings were prepared. The effect of waste loading on waste form performance was tested with respect to flammability, compressive strengths and leachability.

Surrogate Waste Preparation

CIF blowdown simulant was prepared in 2 kg batches, consisting of an aqueous solution with 10 wt. % NaCl and 10 wt. % ASTM Class F flyash. Type F flyash, a non-cementitious byproduct of burning Eastern bituminous or anthracite coal, was selected because of its chemical and physical similarity to anticipated CIF particulate waste. Major constituents of the type F flyash are set forth in Table 7 below.

TABLE 7

| Type F Flyash Composition, wt. % | |
|---|---|
| Amorphous Silica | 51.8–61.7 |
| Aluminum Oxide | 23.0–33.0 |
| Ferric Oxide | 4.2–17.0 |
| Crystalline Silica | 2.0–23.0 |
| Potassium Oxide | 1.6–3.0 |
| Calcium Oxide | 1.0–4.3 |
| Titanium Dioxide | 0.9–3.8 |
| Magnesium Oxide | 0.7–1.0 |
| Sodium Oxide | 0.3–0.5 |

Particle size distribution as characterized by microscan and laser diffraction analysis, indicated that 100% of the mass was finer than about 30 microns with about 40% of the mass (87–99% based on number of particles) finer that 10 microns. Scanning Electron Microscope ("SEM") analyses indicated that particles of both a spherical and crystalline morphology were present as set forth in FIG. 2 hereto. A simulated blowdown solution spiked with heavy metals was similarly prepared for use in preparing leaching test specimens. Target metal concentrations (ppm) in these solutions, based on a Westinghouse Savannah River ("WSRC") pilot-scale metals partitioning test are set forth in Table 8 below.

TABLE 8

| Metal Concentration in Simulated Blowdown Solution, ppm | |
|---|---|
| Antimony | 53.1 |
| Arsenic | 1.4 |
| Barium | 4670.0 |
| Cadmium | 21.4 |
| Chromium | 267.0 |
| Lead | 4680.0 |
| Mercury | 228.0 |
| Nickel | 751.0 |
| Silver | 1950.0 |
| Thallium | 233.0 |

Soluble salts, such as chlorides were used where possible. Precipitation of silver chloride (AgCl) and antimony oxychloride ($SbOCl_2$) precluded dissolution of these species. Analysis of the solution indicated that mercury had also precipitated.

Figure 2:
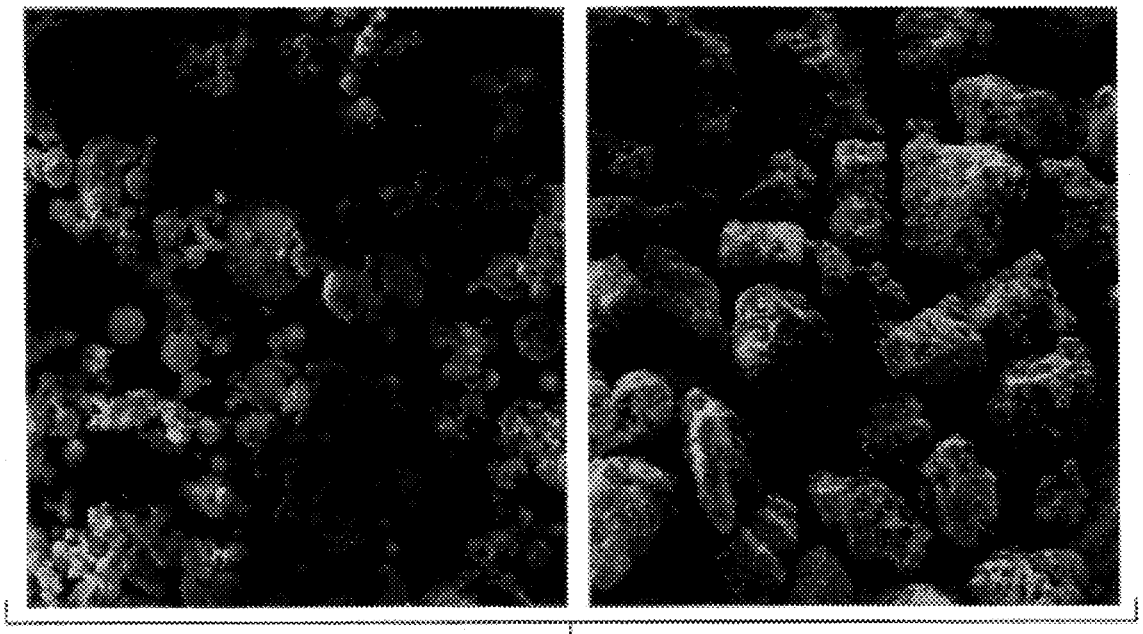
FIG. 2 includes photomicrographs showing dried surrogate for type F flyash and an aqueous liquid blowdown slurry surrogate.

The aqueous blowdown was dewatered using a bench-scale stirred vacuum dryer. The process used a double planetary mixer, operated under heat and vacuum. Drying was stopped when the first visible indication of dust formation occurred. Laser diffraction analysis of dryer bottom samples indicated a bimodal distribution of particle sizes, one peak having a mean of about 200 microns and another at about 40 microns. SEM photographs of the dried surrogate indicate that the fines (flyash) agglomerate in and about NaCl crystals as they grew from the supersaturated solution as shown in FIG. 2 herein. The success of flyash particle agglomeration, desirable for extrusion processing, was indicated by the fact that more than 80% of the mass is greater than 50 microns.

Waste Form Development

The polyethylene waste forms of the present invention were made by using low-density polyethylene as manufactured by Chevron Chemical Co., Houston, Tex. Dry CIF surrogate was incorporated in LDPE binder using a three-zone Killion extruder with a 32 mm diameter screw and a maximum output of 16 kg/hr. Materials were fed by a loss-in-weight feed system. This control system could automatically adjust the relative feed rates within ±1% while maintaining a specified total output rate. The melt temperature was maintained at about 135° C., and melt pressure ranged from 180–200 psi at the 50% loading to 800–1500 psi at 70 wt. % waste. Average densities of LDPE waste forms ranged from 1.21 g/cc at 50 wt. % to 1.45 g/cc at 70 wt. %.

The volumetric waste loading was determined based on density data and as a function of wt. % CIF surrogate. An equivalent volumetric loading of 171.7 g was chosen for CIF waste form baseline testing. This choice resulted in a target waste loading of 61.5 wt. % for LDPE.

Test waste forms were typically cast in 50 mm diameter thin-wall aluminum or polyvinyl chloride (PVC) cylinders. Compressive strength and water immersion test specimens were cut to a final height of 102 mm. Waste form preparation for leachability testing was treated as a specialized task. In order to meet leach test size requirements, test specimens were passed through a 9.5 mm sieve. These specimens were prepared by casting mixtures in 6.3 mm thick Teflon® coated sheets machined with 6.3 mm diameter tapered holes.

Flammability Test

Self and flash ignition temperatures of CIF waste forms were determined in accordance with ASTM Test Method for Ignition Properties of Plastics, Procedure A (D 1929). A hot air ignition furnace was constructed of the design specified in the ASTM test method. Self ignition occurred in the absence of an ignition source. A first approximation of each temperature was made at a heating rate of 600° C./hr at air flow rates of 5, 10 and 20 ft/min. A second approximation was made at 300° C./hr using the flow rate corresponding to the lowest first approximation ignition temperature. Minimum ignition temperature was ascertained by monitoring combustibility while holding the temperature constant for 30 min. Thermocouples placed under and above the sample holder were used to sense a rise in sample temperature relative to the air temperature, indicating ignition. Test samples were 3.0±0.5 grams.

Flammability data for CIF encapsulated in LDPE form samples are compared to values for neat LDPE in Table 9 below.

TABLE 9

Flammability Data for CIF/Thermoplastic Waste Forms

| | Flash Ignition Temperature- (°C.) | | | | | Self Ignition Temperature- (°C.) | | | | |
|---|---|---|---|---|---|---|---|---|---|---|
| | 1st Approximation | | | 2nd Appr. | Min. Ign. | 1st Approximation | | | 2nd Appr. | Min. Ign. |
| Air Flow (ft/min) | 5 | 10 | 20 | * | * | 5 | 10 | 20 | * | * |
| LDPE | 334 | 338 | 378 | 352 | 352 | 336 | 361 | 419 | 364 | 364 |
| LDPE/CIF (61.5 wt. %) | 374 | 374 | 432 | 378 | 378 | 393 | 392 | 426 | 375 | 375 |

Heating Rate: 1st approximation - 600° C./hr; 2nd approximation - 300° C./hr; Minimum Ignition - isothermal
*Air flow used corresponds to the lowest first approximation for ignition temperature.

The results set forth in Table 9 above indicate that encapsulation of the CIF surrogate waste had a noticeable effect on both flash and self ignition temperature, when compared with LDPE alone. For example, a waste form including CIF required approximately 26° C. higher temperature for flash ignition and about 11° C. higher temperature for self-ignition. Thus, the addition of waste to a waste form appears to increase favorably the flash and self-ignition temperatures.

Compressive Strength

Compressive strength testing of LDPE waste forms prepared according to the present invention was also conducted. An identical set of samples was compression tested after immersion in deionized water for 95 days. For testing of LDPE waste form the ASTM test method for compressive properties of rigid plastics (D 695) was followed.

Data for as-prepared and water immersed LDPE waste forms are reported in Table 10 below.

TABLE 10

Compressive Strength Data for CIF/LDPE Waste Forms[a]

| Sample | As-Prepared LDPE | Immersion Tested LDPE |
|---|---|---|
| 1 | 13.44 (1950) | 12.34 (1790) |
| 2 | 15.03 (2180) | 14.96 (2170) |
| 3 | 14.69 (2130) | 15.10 (2190) |
| 4 | 14.75 (2140) | 14.62 (2120) |
| 5 | 14.89 (2160) | 12.48 (1810) |
| 6 | 14.55 (2110) | 13.65 (1980) |
| Mean | 14.55 (2110) | 13.86 (2010) |
| St. Dev. from the Mean | 0.48 (70) | 1.10 (160) |
| 2 Sigma | 0.55 (30) | 1.17 (170) |
| % Error | 3.8 | 8.5 |

[a]Strength data reported as MPa (psi in parenthesis).

The results set forth in Table 10 show that LDPE waste forms had a mean rupture strength of just over 2000 psi, regardless of whether the waste form samples had been immersed in water. This value compares favorably with the NRC minimum requirement for compressive strength of waste forms, which is 60 psi. "Branch Technical Position on Waste Form," Rev. 1, Washington, D.C. (May 1991).

Leachability Test

Leachability of pelletized waste formulations was tested as per the Toxicity Characteristic Leaching Procedure ("TCLP") as provided by U.S. Environmental Protection Agency, in 40 CFR 261, "Identification and Listing of Hazardous Waste,"Fed. Reg. 51, 21865, Jun. 13, 1986. All leaching tests for solidified surrogate were conducted with a leachant having a pH of about 5. One hundred grams of waste pellets encapsulated in LDPE were added to approximately 2 liters of extraction fluid. The solution was agitated in an end-over-end fashion for 18 hours. On completion of the test, the solution was filtered using a 0.8 micron glass fiber filter. An aliquot of the leachate was subsequently analyzed by inductively coupled plasma ("ICP") spectroscopy using a Varian Liberty 100 emission analyzer. The TCLP data are shown in Table 11 below.

TABLE 11

ICP Data (ppm) for TCLP Leachate Samples

| Element | As | Tl | Ag | Ba | Ni | Hg | Cr | Sb | Pb | Cd |
|---|---|---|---|---|---|---|---|---|---|---|
| Reg Limit (Characteristic)[2] | 5.0 | NA[1] | 5.0 | 100.0 | NA | 0.2 | 5.0 | NA | 5.0 | 1.0 |
| Untreated Surrogate: Dry Surr-Unsolidified | 0.39 | 45.9 | 0.88 | 358.0 | 34.3 | 0.14 | 1.06 | 0.14 | 325.0 | 2.49 |
| LDPE (61.5 wt. % Surr)[3] | <0.01 | 1.58 | <0.003 | 21.2 | 0.62 | <0.009 | <0.004 | <0.018 | 14.2 | 0.09 |
| Surrogate + Additive: LDPE (25 wt. % Surr + 5 wt. % Add)[4] | 0.19 | 0.33 | <0.003 | 1.98 | 0.19 | 0.01 | <0.004 | <0.018 | <0.014 | <0.002 |
| LDPE (35 wt. % Surr + 7 wt. % Add) | 0.15 | 0.27 | <0.003 | 1.93 | 0.18 | 0.01 | <0.004 | <0.018 | <0.014 | <0.002 |

NA = Not Applicable
40 CFR Parts 261, 271, and 302
Waste was treated with aqueous anti-leaching additive
Waste was treated with anhydrous anti-leaching additive From the results set forth in Table 11 above, it is apparent that TCLP leachate concentrations for polyethylene specimens were lower than the allowable concentrations for each of the metals except lead. Consequently, two further formulations and TCLP tests were conducted to try to reduce contamination concentrations below all proposed regulatory levels. These formulations contained dry CIF surrogate at 25 and 35 wt. % in LDPE. An anhydrous additive was added to the dry waste prior to LDPE encapsulation to decrease the mobility of solubilized metals. The weight ratio of dry surrogate to additive was maintained at 5:1. The TCLP data on these leachates is also shown in Table 11. All hazardous metal concentrations were reduced below EPA regulatory listed limits. The data set forth in Table 11 further shows that mixing an anhydrous additive with the dry waste surrogate at the time of processing, combined with reducing the waste loading, from 65 wt. % to 25–35 wt. % produced highly successful TCLP leaching results. For example, lead concentrations for the LDPE specimens were reduced from 14.2 ppm to a level that could not be detected, i.e., less than about 0.01 ppm. If waste loading effects are estimated to be linear, the expected reduction in TCLP concentration would be a factor of about two.

Thus, while there have been described what are presently believed to be the preferred embodiments of the present invention, those skilled in the art will realize that other and further modifications can be made without departing from the true spirit of the invention, and it is intended to include all such modifications and variations as come within the scope of the claims as appended herein.

We claim:

1. A composition which prevents leaching of radioactive, hazardous and mixed waste comprising:

(a) dry waste including radioactive, hazardous and mixed waste having a particle size reduced to not greater than 3,000 microns present in said composition in an amount of from about 10% to about 70% by weight;

(b) a non-biodegradable thermoplastic polymer present in said composition in an amount from about 30% to about 90% by weight; and (c) an anhydrous, anti-leaching additive capable of forming a precipitate with a component of said dry waste said additive present in said composition in an amount up to about 10% by weight.

2. The composition of claim 1, wherein said non-biodegradable thermoplastic polymer is selected from the group consisting of polyethylene, polyvinyl chloride, polypropylene and mixtures thereof.

3. The composition of claim 2, wherein said non-biodegradable thermoplastic polymer is low-density polyethylene.

4. The composition of claim 1, wherein said additive is selected from the group consisting of calcium hydroxide, sodium hydroxide, sodium sulfide, calcium oxide, magnesium oxide, and mixtures thereof.

5. The composition of claim 1, wherein said additive is sodium sulfide.

6. The composition of claim 1, wherein said radioactive, hazardous and mixed waste are in an amount greater than 16 wt. % and up to about 61.5 wt. %.

7. The composition of claim 3, further comprising an exterior layer of substantially pure polyethylene.

8. A composition which prevents leaching of radioactive, hazardous and mixed waste comprising:

(a) dry waste including radioactive, hazardous and mixed waste having a particle size reduced to not greater than 3,000 microns;

(b) a non-biodegradable thermoplastic polymer; and (c) an anhydrous, anti-leaching additive capable of forming a precipitate with a component of said dry waste, wherein said dry waste and said anhydrous, anti-leaching additive are preferably in a ratio of 5:1.

9. A composition which prevents leaching of radioactive, hazardous and mixed waste comprising:

(a) dry waste including radioactive, hazardous and mixed waste having a particle size reduced to not greater than 3,000 microns;

(b) a non-biodegradable thermoplastic polymer; and (c) an anhydrous, anti-leaching amount of sodium sulfide, wherein said dry waste is present in a concentration from about 10% to about 70% by weight, said non-biodegradable thermoplastic polymer is present in a concentration from about 30% to about 90% by weight, and said sodium sulfide is present in a concentration from about up to about 10% by weight.

10. A waste form which comprises a core having a composition including:

(a) dry waste including radioactive, hazardous and mixed waste having a particle size reduced to not greater than 3,000 microns;

(b) a non-biodegradable thermoplastic polymer; and (c) an anhydrous, anti-leaching additive capable of forming a precipitate with a component of said dry waste, wherein said dry waste is present in a concentration from about 10% to about 70% by weight, said non-biodegradable thermoplastic polymer is present in a concentration from about 30% to about 90% by weight, and said additive is present in a concentration from about up to about 10% by weight; and an exterior layer of substantially pure polyethylene covering said core composition.

* * * * *